United States Patent [19]

Sasaki et al.

[11] 4,424,269

[45] Jan. 3, 1984

[54] ELECTROPHOTOGRAPHIC CDS OR CDSSE WITH OZONE DETERIORATION INHIBITOR

[75] Inventors: Hideyuki Sasaki, Morioka; Toru Nakazawa, Kumatori; Yoshiaki Kato, Hirakata; Hideo Fukuda, Katano; Yasushi Kamezaki, Sakai; Akira Fushida, Suita, all of Japan

[73] Assignee: Mita Industrial Co., Ltd., Osaka, Japan

[21] Appl. No.: 356,215

[22] Filed: Mar. 8, 1982

[30] Foreign Application Priority Data

Mar. 10, 1981 [JP] Japan ..... 56-33136

[51] Int. Cl.[3] ..... G03G 5/087

[52] U.S. Cl. ..... 430/94; 430/95; 430/96

[58] Field of Search ..... 430/94, 95, 96

[56] References Cited

U.S. PATENT DOCUMENTS

| | | | |
|---|---|---|---|
| 3,406,063 | 10/1968 | Matkan et al. | 430/96 X |
| 3,592,711 | 7/1971 | De Senarclens et al. | 428/324 X |
| 3,928,035 | 12/1975 | Curtin | 430/81 |

FOREIGN PATENT DOCUMENTS

| | | | |
|---|---|---|---|
| 2656075 | 6/1977 | Fed. Rep. of Germany | 430/96 |
| 44-14875 | 7/1969 | Japan | 430/95 |
| 44-27560 | 11/1969 | Japan | 430/96 |
| 50-145135 | 11/1975 | Japan | 430/96 |
| 1102348 | 2/1968 | United Kingdom | 430/96 |

OTHER PUBLICATIONS

Modern Plastics, vol. 38, No. 1A, Sep. 1960, p. 220.

*Primary Examiner*—Roland E. Martin, Jr.
*Attorney, Agent, or Firm*—Sherman & Shalloway

[57] ABSTRACT

Disclosed is a photosensitive plate for electrophotography, which comprises a conductive substrate and a layer of a composition formed by dispersing a photoconductor in a binder resin, which is formed on the substrate, wherein the resin binder comprises an epoxy resin component and an amine type curing agent component and the resin binder further comprises an acid anhydride as the ozone deterioration preventing agent.

This photosensitive plate is excellent in the ozone resistance and the moisture resistance.

6 Claims, No Drawings

ELECTROPHOTOGRAPHIC CDS OR CDSSE WITH OZONE DETERIORATION INHIBITOR

BACKGROUND OF THE INVENTION (1) Field of the Invention

The present invention relates to a photosensitive plate for electrophotography. More particularly, the present invention relates to a photosensitive plate for electrophotography which is excellent in the ozone resistance and moisture resistance.

(2) Description of the Prior Art

A photosensitive plate comprising a conductive substrate and a layer of a composition formed by dispersing a photoconductor in a binder resin, which is formed on the substrate, has been widely used as one type of photosensitive plates for electrophotography. In the electrophotographic reproduction, this photosensitive plate is charged by corona discharge of a certain polarity and is then subjected to imagewise light exposure to form an electrostatic latent image, the electrostatic latent image is developed with a toner, the toner image is transferred to a copy sheet from the photosensitive plate, and finally, the surface of the photosensitive plate is cleaned. Thus, one cycle of the reproduction is completed.

Among photoconductive pigments used for photosensitive plates of the above-mentioned type, cadmium sulfide is especially excellent in the sensitivity. However, it has been found that when a photosensitive plate including cadmium sulfide as the photoconductor is used for a long time repeatedly for the reproduction under high humidity conditions, the image density is drastically reduced.

We made researches with a view to clarifying the cause of this undesirable phenomenon. As a result, it was found that cadmium sulfide which is an n-type photoconductor always undergoes the attack of ozone since corona discharge of a negative polarity is carried out, whereby cadmium sulfide is rendered sensitive to the moisture and the initial charge voltage is reduced while the reproduction is repeated and that when a combination of an epoxy resin and an amine type curing agent is used as the binder resin for dispersing a photoconductor such as cadmium sulfide and an acid anhydride is incorporated as the ozone degradation preventing agent in this composition, the ozone resistance and moisture resistance of the photosensitive plate can prominently be improved.

SUMMARY OF THE INVENTION

In accordance with the present invention, there is provided a photosensitive plate for electrophotography, which comprises a conductive substrate and a layer of a composition formed by dispersing a photoconductor in a binder resin, which is formed on the substrate, wherein the resin binder comprises an epoxy resin component and an amine type curing agent component and the resin binder further comprises an acid anhydride as the ozone deterioration preventing agent.

DETAILED DESCRIPTION OF THE PREFERRED EMBODIMENTS

In the present invention, an epoxy resin composition comprising an epoxy resin component and an amine type curing agent is used as the binder resin. An epoxy resin composition of this type is curable at normal temperatures or under mild conditions, and is prominently excellent in the electric characteristics and moisture resistance. However, when a photosensitive layer comprising this epoxy resin composition as the binder and a cadmium sulfide type photoconductor is exposed repeatedly to the attack of ozone, the photosensitive layer is rendered sensitive to the moisture. More specifically, an as-prepared CdS-epoxy resin photosensitive layer has a saturation charge voltage of, for example, 657 V, while when this photosensitive layer is subjected to corona discharge of a negative polarity, it shows such a low saturation charge voltage of 103 V under high-temperature high-humidity conditions of a temperature of 30° C. and a relative humidity of 80%. The cause of this drastic reduction of the charge voltage has not been completely elucidated. However, it is presumed that even if the oxirane ring of the epoxy resin is opened and crosslinking and polymerization are caused by addition of the amine type curing agent, a great number of hydroxyl groups formed by opening of the oxirane ring are present in the molecule chain and the hydrophilic characteristic given by these hydroxyl groups is further enhanced by contact with ozone, resulting in the above-mentioned reduction of the saturation charge voltage. This presumption is supported by the fact that the as-prepared CdS-epoxy resin photosensitive layer shows a water repellency when immersed in water, while when the ozone-treated CdS-epoxy resin photosensitive layer is immersed in water, the surface of the photosensitive layer is uniformly wetted with water.

In contrast, if a binder formed by incorporating an acid anhydride such as phthalic anhydride as an ozone deterioration preventing agent into a composition comprising an epoxy resin component and an amine type curing agent component is used for a CdS photoconductor according to the present invention, even when the resulting photosensitive layer is subjected to corona discharge repeatedly and exposed to high-temperature high-humidity conditions, the saturation charge voltage is not substantially reduced from the level of the untreated as-prepared photosensitive layer.

Phthalic anhydride is most preferably used as the ozone deterioration preventing agent consisting of an acid anhydride in the present invention. Among acid anhydrides, phthalic anhydride is especially excellent in the effect of improving the ozone resistance and moisture resistance. Other acid anhydrides, such as tetrahydrophthalic anhydride, hexahydrophthalic anhydride, methylnadic anhydride, dodecenylsuccinic anhydride, chlorendic anhydride, trimellitic anhydride, pyromellitic anhydride, succinic anhydride and maleic anhydride, may be used although their effects are lower than that of phthalic anhydride. In the present invention, these acid anhydrides may be used singly or in the form of a mixture of two or more of them.

The acid anhydride that is used as the ozone deterioration preventing agent in the present invention is known as a high temperature curing agent for an epoxy resin. However, in the present invention, an amine type curing agent, which is a low temperature or medium temperature curing agent, acts as a curing agent for an epoxy resin, and the acid anhydride is distinguishable over the curing agent in the function because it acts as an agent for improving the ozone resistance and moisture resistance of the epoxy resin.

In the present invention, a known epoxy resin component containing at least two oxirane rings in the molecule is used as the epoxy resin component. Preferred examples of epoxy resin components that can be used in the present invention are described below, though the epoxy resin components that can be used in the present invention are not limited to those exemplified below.

Glycidyl ether type epoxy resins

For example, there can be mentioned epoxy resins derived from polyfunctional hydroxyl group-containing compounds such as bisphenol A, brominated bisphenol A, bisphenol F, tetrahydroxyphenylethane, resorcinol, novolaks, polyalkylene glycols and glycerin and epihalohydrins.

Glycidyl ester type epoxy resins

For example, there can be mentioned glycidyl phthalate, glycidyl hexahydrophthalate and glycidyl esters of dimer acids.

Glycidyl amines

For example, there can be mentioned triglycidyl isocyanurate and tetraglycidyldiaminodiphenylmethane.

Alicyclic epoxy resins

For example, there can be mentioned 3,4-epoxy-6-methylcyclohexylmethyl-3,4-epoxy-6-methylcyclohexane carboxylate, vinylcyclohexene diepoxide, dicyclopentadiene oxide and bis(2,3-epoxycyclopentyl)ether.

A bis-epoxide having an epoxy equivalent of 150 to 500, especially 150 to 300, particularly a bisphenol type epoxy resin, is preferred in the present invention.

A low temperature or medium temperature amine type curing agent is used in combination with the epoxy resin in the present invention. As preferred examples, there can be mentioned aliphatic polyamines such as diethylene triamine, triethylene tetramine, diethylaminopropylamine, menthene diamine, N-aminoethylpiperazine, m-xylylene diamine, 3,9-bis(3-aminopropyl)-2,4,8,10-tetroxaspiro[5,5]undecane and bis(4-amino-3-methylcyclohexyl)methane, modified aliphatic polyamines such as epoxy resin-polyamine adducts, polyamine-ethylene oxide adducts, polyamine-propylene oxide adducts, cyanoethylated polyamines and ketone-blocked polyamines, and aromatic polyamines such as metaphenylene diamine, 4,4'-methylene dianiline and diaminodiphenyl sulfone.

In the present invention, the epoxy resin component and amine type curing agent component may be used in a known ratio, for example, a weight ratio of from 100/1 to 100/200. It is preferred that acid anhydride type ozone deterioration preventing agent be used in an amount of 0.1 to 50 parts by weight, especially 1 to 40 parts by weight, per 100 parts by weight of the epoxy resin component. If the amount of the acid anhydride is too small and below the above range, no prominent effect of improving the ozone resistance and moisture resistance can be obtained, and if the amount of the acid anhydride is too large and exceeds the above range, the sensitivity of the photosensitive layer tends to decrease.

In the present invention, especially good results can be obtained when a photoconductive pigment of the type that is charged by negative corona discharge, particularly a photoconductor of which the moisture resistance is drastically reduced by the ozone treatment, namely a cadmium sulfide photoconductor, is employed. Any of cadmium sulfide type photoconductors known in the field of electrophotography can be used in the present invention. It is known that cadmium sulfide is activated or sensitized by, for example, copper or chlorine. CdS photoconductor particles sensitized by copper or the like can advantageously be used for attaining the objects of the present invention. Instead of cadmium sulfide, there may advantageously be used cadmium sulfide selenide, that is, a CdS-CdSe solid solution, in the state activated by copper or the like.

The CdS type photoconductor is used in an amount of 20 to 500 parts by weight, especially 50 to 300 parts by weight, per 100 parts by weight of the epoxy resin component in the present invention.

In the production of the photosensitive plate of the present invention, the above-mentioned epoxy resin component, amine type curing agent component, acid anhydride type ozone degradation preventing agent and CdS type photoconductor are dissolved or dispersed in an cyclic ether such as tetrahydrofuran, a ketone such as methylethyl ketone, an aromatic solvent such as toluene or a halogenated hydrocarbon such as dichloroethane or monochlorobenzene, and the resulting coating composition is coated on a known conductive substrate. At this coating step, the epoxy resin component used in the present invention exerts a function of sufficiently dispersing the CdS type photoconductor in the coating composition. The solid concentration of the coating composition is changed according to the coating method, but is ordinarily preferred that the solid concentration be 20 to 50% by weight. Moreover, it is preferred that the thickness of the photosensitive layer formed on the substrate be 10 to 100μ, especially 15 to 50μ, as the solids.

The present invention will now be described in detail with reference to the following Examples that by no means limit the scope of the present invention.

EXAMPLE 1

Cadmium sulfide powder (PC-108 supplied by Silvania Co.)—8 g
Tetrahydrofuran—4 g
Bisphenol type epoxy resin (epoxy equivalent=192)—2.6 g
Amine adduct curing agent—1.4 g
Phthalic anhydride—0.4 g The above ingredients, which had been precisely weighed, were sufficiently dispersed in an ultrasonic dispersing machine. The dispersion was coated on an aluminum plate having a thickness of 80μ by a wire bar and cured for 1 hour in an oven maintained at 100° C. to obtain a photosensitive plate comprising a photosensitive layer having a thickness of 25μ after the thermal curing treatment. The charge quantity of the photosensitive plate was measured under the conditions described below by using an electrostatic paper analyzer supplied by Kawaguchi Denki K.K.

Measuring method: Static method II
Applied voltage:—6 kilovolts

It was found that the initial charge voltage ($V_1$) was 691 volts.

Then, the photosensitive plate was subjected to the ozone treatment in the following manner.

The photosensitive plate was attached to an electrophotographic copying machine (Model DC-15 supplied by Mita Industrial Co.) from which the development unit had been removed, and the process of charging, light exposure, transfer and electricity removal without feeding of a transfer sheet was repeated for 2000 cycles.

Then, the ozone-treated photosensitive plate was allowed to stand still in a thermostat chamber maintained at a temperature of 30° C. and a relative humidity of 80% for 6 hours. After this humdifying treatment, the charge quantity was measured in the same manner as described above.

It was found that the charge quantity ($V_2$) after the ozone treatment and humidifying treatment was 675 volts.

When the values $V_1$ and $V_2$ were compared, it was seen that there was no substantial difference between the two values and the photosensitive plate was not substantially deteriorated in a high humidity atmosphere by the ozone treatment.

COMPARATIVE EXAMPLE 1

A photosensitive plate was prepared in the same manner as described in Example 1 except that phthalic anhydride was not incorporated into the coating composition. The photosensitive plate was tested in the same manner as described in Example 1 to obtain the following results.

$V_1$=657 vols $V_2$=103 volts

From the fact that the value $V_2$, that is, the charge quantity after the ozone treatment and humidifying treatment, was much smaller than the initial charge quantity $V_1$, it was confirmed that the deterioration of the photosensitive plate in a high humidity atmosphere by the ozone treatment was conspicuous.

EXAMPLE 2

Cadmium sulfide powder (PCP-MT supplied by Kasei Optonics K.K.) —8 g

Tetrahydrofuran—4 g

Bisphenol type epoxy resin (epoxy equivalent=200)—2.9 g

Amine adduct type curing agent—1.1 g

Phthalic anhydride—0.6 g

The foregoing ingredients, which had been precisely measured, were sufficiently dispersed by an ultrasonic dispersing machine, and the resulting dispersion was coated on an aluminum plate having a thickness of 80μ by a wire bar and heat-treated in an oven maintained at 100° C. for 1 hour to obtain a photosensitive plate comprising a photosensitive layer having a thickness of 25μ after the heat treatment.

The photosensitive plate was tested in the same manner as described in Example 1 to obtain the following results.

$V_1$=702 volts $V_2$=674 volts

When both the values $V_1$ and $V_2$ were compared, it was seen that the charge quantity was not greatly changed and the deterioration of the photosensitive plate in a high humidity atmosphere by the ozone treatment was not conspicuous.

COMPARATIVE EXAMPLE 2

A photosensitive plate was prepared in the same manner as described in Example 2 except that phthalic anhydride was not incorporated in the coating composition, and the photosensitive plate was tested in the same manner as described in Example 1 to obtain the following results.

$V_1$=661 volts $V_2$=117 volts

From the fact that the charge quantity $V_2$ after the ozone treatment and humidifying treatment was much smaller than the initial charge quantity $V_1$, it was seen that the deterioration of the photosensitive plate in a high humidity atmosphere by the ozone treatment was conspicuous.

EXAMPLE 3

Cadmium sulfide powder (PCP-MT supplied by Kasei Optonics K.K.)—8 g

Tetrahydrofuran—4 g

Bisphenol type epoxy resin (epoxy equivalent=188)—4 g

Amine adduct type curing agent—1.5 g

Phthalic anhydride—0.4 g

The foregoing ingredients, which had been precisely measured, were sufficiently dispersed by an ultrasonic dispersing machine, and the resulting dispersion was coated on an aluminum plate having a thickness of 80μ by a wire bar and heat-treated in an oven maintained at 150° C. for 1 hour to obtain a photosensitive plate comprising a photosensitive layer having a thickness of 24μ after the heat treatment.

The photosensitive plate was tested in the same manner as described in Example 1 to obtain the following results.

$V_1$=725 volts $V_2$=700 volts

When both the values $V_1$ and $V_2$ were compared, it was seen that the charge quantity was not greatly changed and the deterioration of the photosensitive plate in a high humidity atmosphere by the ozone treatment was not conspicuous.

COMPARATIVE EXAMPLE 3

A photosensitive plate was prepared in the same manner as described in Example 3 except that phthalic anhydride was not incorporated in the coating composition, and the photosensitive plate was tested in the same manner as described in Example 1 to obtain the following results.

$V_1$=695 volts $V_2$=130 volts

From the fact that the charge quantity $V_2$ after the ozone treatment and humidifying treatment was much smaller than the initial charge quantity $V_1$, it was seen that the deterioration of the photosensitive plate in a high humidity atmosphere by the ozone treatment was conspicuous.

What is claimed is:

1. A photosensitive plate for electrophotography, which comprises a conductive substrate and a layer of a composition formed by dispersing a photoconductor in a binder resin, which is formed on the substrate, wherein said composition comprises (a) the resin binder which comprises an epoxy resin component and an amine type curing agent component, (b) 0.1 to 50 parts by weight, per 100 parts by weight of the epoxy resin component of an acid anhydride as the ozone deterioration preventing agent and (c) 20 to 500 parts by weight, per 100 parts by weight of the epoxy resin component of cadmium sulfide or cadmium sulfide selenide as the photoconductor.

2. A photosensitive plate as set forth in claim 1, wherein the acid anhydride is phthalic anhydride.

3. A photosensitive plate as set forth in claim 1, wherein the photoconductor is cadmium sulfide.

4. A photosensitive plate as set forth in claim 1, wherein the epoxy resin component is a bis-epoxide having an epoxy equivalent of 150 to 500.

5. In a process of electrophotographic reproduction by the steps of (i) charging a photosensitive plate which includes a conductive substrate and a layer of a composition of an epoxy resin-amine type curing agent binder and cadmium sulfide or cadmium sulfide selenide dispersed therein by corona discharge of negative polarity, (ii) subjecting the charged plate to imagewise light exposure to form an electrostatic image, (iii) developing the electrostatic image with a toner, (iv) transferring the toner image from the plate to a copy sheet, and (v) cleaning the surface of the plate, the improvement which comprises incorporating in said composition 0.1 to 50 parts by weight, per 100 parts by weight of the epoxy resin component, of an acid anhydride as the ozone deterioration preventing agent.

6. The process of claim 5 wherein the acid anhydride is phthalic anhydride.

* * * * *